US006168405B1

(12) United States Patent
Nosenchuck

(10) Patent No.: US 6,168,405 B1
(45) Date of Patent: Jan. 2, 2001

(54) WANKEL TYPE PUMP FOR TRANSPORTING FLUID WITH ENTRAINED PARTICULATE MATTER

(75) Inventor: Daniel M. Nosenchuck, Mercerville, NJ (US)

(73) Assignee: SounDesign, L.L.C., Mercerville, NJ (US)

( * ) Notice: Under 35 U.S.C. 154(b), the term of this patent shall be extended for 0 days.

(21) Appl. No.: 09/434,350

(22) Filed: Nov. 5, 1999

Related U.S. Application Data

(63) Continuation of application No. 09/021,069, filed on Feb. 9, 1998, now Pat. No. 6,014,791.

(51) Int. Cl.[7] ..... A47L 5/12; F01C 1/00

(52) U.S. Cl. ..... 418/61.2; 418/122; 418/129; 15/327.1

(58) Field of Search ..... 418/61.2, 122, 418/129, 142

(56) References Cited

U.S. PATENT DOCUMENTS

| | | | |
|---|---|---|---|
| 1,506,016 | | 8/1924 | Lundgren . |
| 2,011,234 | | 8/1935 | Thompsom . |
| 2,470,319 | | 5/1949 | Norris . |
| 2,909,800 | | 10/1959 | Grindle et al. . |
| 3,033,180 | | 5/1962 | Bentele . |
| 3,465,729 | | 9/1969 | Jones . |
| 3,549,110 | | 12/1970 | Cotton . |
| 3,655,300 | | 4/1972 | Davis . |
| 3,655,303 | | 4/1972 | Cotton . |
| 3,828,390 | | 8/1974 | Cater . |
| 3,851,999 | | 12/1974 | Bibbens . |
| 3,853,437 | | 12/1974 | Horn et al. . |
| 3,876,346 | | 4/1975 | Kokochak . |
| 3,880,555 | | 4/1975 | Dega . |
| 3,885,799 | | 5/1975 | Bibbens . |
| 3,899,272 | | 8/1975 | Pratt . |
| 4,028,021 | | 6/1977 | Berkowitz . |
| 4,043,714 | | 8/1977 | Berkowitz . |
| 4,278,409 | | 7/1981 | Eiermann . |
| 4,296,500 | | 10/1981 | Monties . |
| 4,418,443 | | 12/1983 | Fischer . |
| 4,435,877 | | 3/1984 | Berfield . |
| 4,507,066 | | 3/1985 | Duffy . |
| 4,512,713 | | 4/1985 | Berfield . |
| 4,970,753 | | 11/1990 | Herron, Jr. . |
| 5,159,738 | | 11/1992 | Sunagawa et al. . |
| 5,181,796 | | 1/1993 | DeYoung . |
| 5,388,428 | | 2/1995 | Harper . |
| 5,391,067 | | 2/1995 | Saunders . |
| 5,499,423 | | 3/1996 | Joo et al. . |
| 5,502,869 | | 4/1996 | Smith et al. . |
| 5,513,417 | | 5/1996 | Kim et al. . |
| 5,944,499 | * | 8/1999 | Morita ..... 418/61.2 |

FOREIGN PATENT DOCUMENTS

| | | | |
|---|---|---|---|
| 4204186 | | 8/1993 | (DE) . |
| 2077357 | | 12/1981 | (GB) . |
| 60-164686 | * | 8/1985 | (JP) . |

* cited by examiner

*Primary Examiner*—Randall E. Chin
(74) *Attorney, Agent, or Firm*—David M. Quinlan

(57) ABSTRACT

A quiet, inexpensive pump especially adapted for transporting fluid having particulate matter entrained therein comprises a one-piece housing having a chamber therein with an epitrochoidal planform satisfying the equation:

$$x=(a+b)\cdot\cos(t)-c\cdot\cos((a/b+1)\cdot t), \text{ and}$$

$$y=(a+b)\cdot\sin(t)-c\cdot\sin((a/b+1)\cdot t),$$

x and y being plotted from a center of said chamber, wherein $0 \leqq t \leqq 2\pi$, a/b is an integer defining the number of lobes of said chamber, and b/c=2. A stator gear at the center of the chamber has (a/b)·n teeth, wherein n is an integer. A one-piece rotor, with a generally polygonal planform having a/b+1) curved sides, rotates eccentrically within the chamber. Apexes of said rotor are spaced from walls of said chamber to maintain a clearance between said apexes and said walls as said rotor rotates in said chamber, for permitting fluid flow through said clearance.

23 Claims, 7 Drawing Sheets

FIG. 8(a)
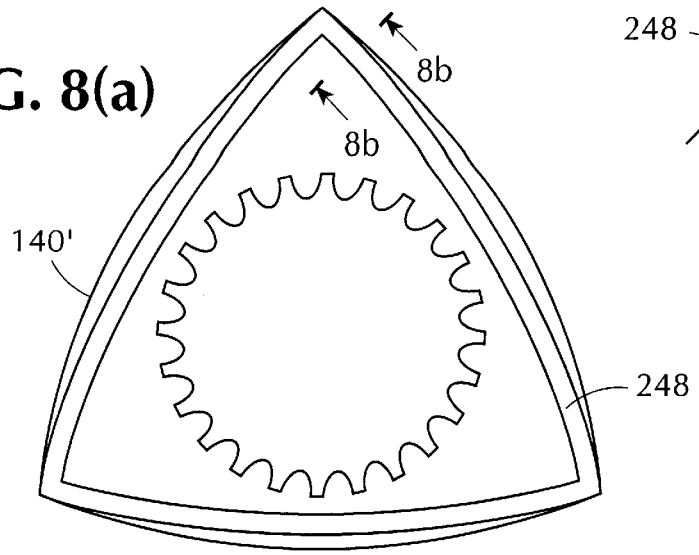
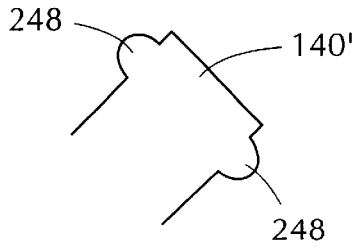
FIG. 8(b)
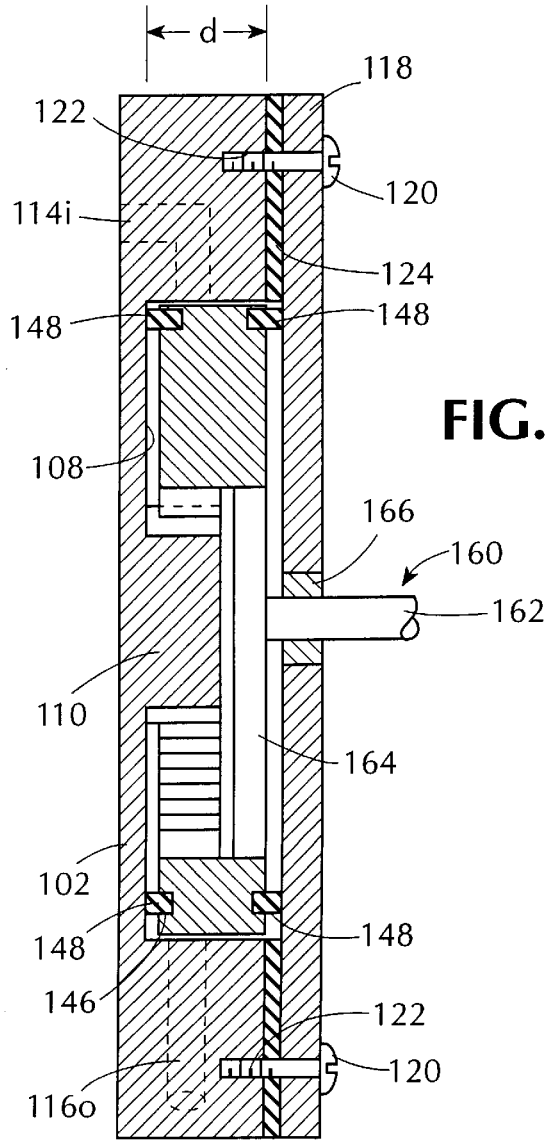
FIG. 4

FIG. 9(a)
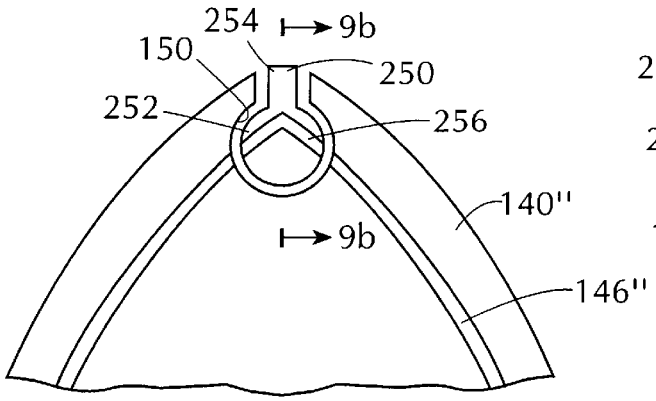
FIG. 9(b)
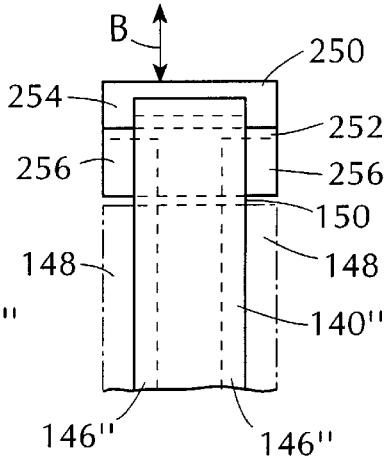
FIG. 10
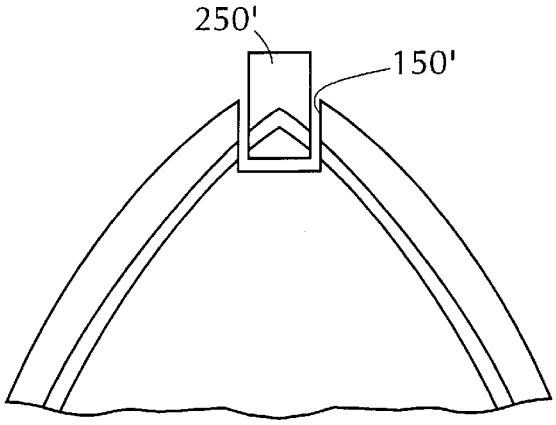
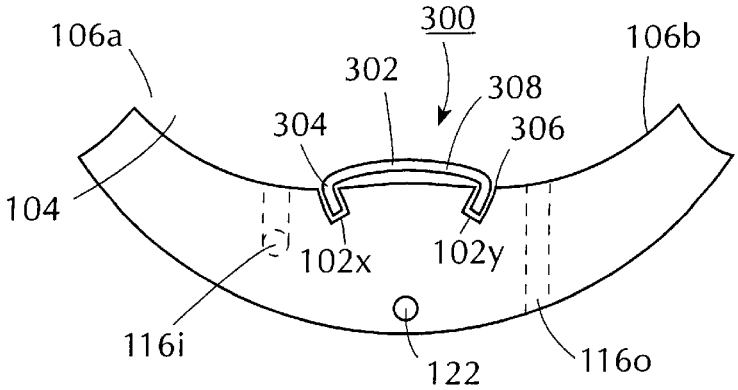
FIG. 11

WANKEL TYPE PUMP FOR TRANSPORTING FLUID WITH ENTRAINED PARTICULATE MATTER

CROSS-REFERENCE TO RELATED APPLICATIONS

This is a continuation of application Ser. No. 09/021,069, filed Feb. 9, 1998, U.S. Pat. No. 6,014,791.

BACKGROUND OF THE INVENTION

1. Field of the Invention

The present invention relates to a vacuum cleaner, and more particularly, to a vacuum cleaner that creates substantially less noise by using a vacuum pump with a lobed chamber.

2. Description of Related Technology

Although vacuum cleaners have become virtually indispensable, the noise they create limits their utility because other nearby activities often must cease during vacuuming.

There have been many approaches to reducing the environmental noise from vacuum cleaners. One rather obvious one is to incorporate sound insulating material in the vacuum cleaner housing. While this approach will somewhat reduce the noise level around the vacuum cleaner, it does not actually attack at its source any of the noise generated by the vacuum cleaner. Another involves using muffler arrangements for the exhaust air flow. A more sophisticated approach to reducing exhaust noise uses a noise detector in the vacuum cleaner exhaust to provide a signal used to generate noise-canceling sound. A sampling of such approaches can be found in U.S. Pat. No. 4,418,443, No. 4,435,877, No. 4,512,713, No. 4,970,753, No. 5,502,869, No. 5,159,738, No. 5,499,423 and No. 5,513,417.

However, none of those approaches attacks two appreciable sources of noise in a vacuum cleaner. One of those sources is the high flow velocities that must be generated by existing vacuum cleaners to obtain a mass flow rate that will provide effective cleaning. The other is noise caused by the vacuum cleaner's rotating components.

According to well known principles, so-called "dipole noise," $N_{db}$, caused by rotating components satisfies the relationship:

$$N_{db}\ \omega^6 \tag{1}$$

From equation (1) it can seen that dipole noise is proportional to the sixth power of the rotational speed ω of the flow-generating components of a vacuum cleaner. Therefore, very small increases or decreases in the rotational speed ω will have a great effect on the dipole noise.

The prior art approaches discussed above operate to mask the "jet noise" associated with the air stream exiting the vacuum cleaner housing. The approaches that use muffler arrangements generally seek to reduce the velocity of the air stream before allowing it to exit the vacuum cleaner. That approach results in meaningful jet noise reduction because jet noise scales to the eighth power of air flow velocity (that is, $U^8$). Even further noise reductions would be possible if the velocity of the air flow exiting the vacuum cleaner impeller device were reduced.

The present invention uses a positive displacement vacuum pump to reduce noise, and there are no known vacuum cleaners that incorporate such a pump to create the pressure drop that produces the debris-entraining air flow in a vacuum cleaner. The reason for that lack in the prior art is quite likely due to the mechanical complexity of the most common types of positive displacement pumps. For example, a pump having a reciprocating piston would require complicated valving and parts manufactured to close tolerances. The cost of a vacuum cleaner incorporating such a pump would probably be much more than could be charged for a consumer product, and it would be far less reliable than existing vacuum cleaners that simply use a rotating impeller.

As a result, there are no known vacuum cleaners with a Wankel-type positive displacement pump. Wankel-type devices were simply a curiosity until solution of the problem of providing adequate sealing between the rotating "piston" and the walls of the stationary "cylinder." While solutions to these problems are now well known, they would probably be considered exotic for a product such as a vacuum cleaner. In any event, they would certainly drive up the cost of a vacuum cleaner and would require frequent replacement because the compressor in a vacuum cleaner is subject to abrasion from the particulate matter entrained in the air flow.

SUMMARY OF THE INVENTION

It is an object of the present invention to provide a Wankel-type pump suitable for use in a vacuum cleaner.

It is another object of the present invention to provide a quiet vacuum cleaner by using a Wankel-type pump and thereby substantially reduce the dipole noise generated during operation of the vacuum cleaner and create a suitable pressure drop and mass flow rate at lower fluid flow velocities, thereby also reducing the jet noise associated with conventional vacuum cleaners.

It is still another object of the present invention to provide a vacuum cleaner capable of generating a reduced-pressure fluid flow in which matter can be entrained for transport from one location to another, comprising a compartment for collecting the entrained matter, and a vacuum pump having a chamber with a plurality of lobes and a generally polygonal rotor with a plurality of sides greater in number than the plurality of lobes, the rotor being mounted for eccentric rotation within the lobed chamber to generate a reduced pressure in the lobes as the rotor rotates relative to the chamber, wherein the chamber is operatively connected to the compartment to induce the fluid flow therethrough.

In one embodiment of such a vacuum cleaner, the fluid is air and the chamber has an epitrochoidal planform satisfying the equation $$x=(a+b)\cdot\cos(t)-c\cdot\cos((a/b+1)\cdot t),\ \text{and}$$

$$y=(a+b)\cdot\sin(t)-c\cdot\sin((a/b+1)\cdot t),$$

x and y being plotted from a center of the chamber, wherein $0 \leqq t \leqq 2\pi$, b/c=2, and a/b=2, thereby providing a chamber with two lobes, and the rotor is generally triangular (that is, a regular polygon having (a/b+1) sides) with curved sides.

In accordance with a preferred embodiment of the present invention, a vacuum cleaner capable of generating a reduced-pressure air flow in which matter can be entrained for transport from one location to another, comprises a compartment for collecting the entrained matter, the compartment having an inlet and an outlet for the air flow, a vacuum pump housing including a chamber with an epitrochoidal planform satisfying the equation $$x=(a+b)\cdot\cos(t)-c\cdot\cos((a/b+1)\cdot t),\ \text{and}$$

$$y=(a+b)\cdot\sin(t)-c\cdot\sin((a/b+1)\cdot t),$$

x and y being plotted from a center of the chamber, wherein $0 \leqq t \leqq 2\pi$, a/b is an integer defining the number of lobes of the chamber, and b/c=2, the chamber having plural outlet ports, at least one of the outlet ports being disposed in each of the lobes of the chamber, and plural inlet ports, at least one of the inlet ports being disposed in each of the lobes of the chamber, a stator gear in the chamber at the center thereof, the gear having (a/b)·n teeth (n being an integer), a generally polygonal, one-piece rotor with (a/b+1) curved sides, the rotor being disposed for eccentric rotation in the chamber, wherein at least one inlet and one outlet in each lobe of the chamber are in direct fluid communication during a portion of the rotation of the rotor, a rotor gear at a center of the rotor, the rotor gear having (a/b+1)·n teeth, a cover mounted to the housing to enclose the chamber, seals on opposing surfaces of the rotor facing the housing and the cover, a drive member including a disc fitting within a circular opening in the rotor and mounted eccentrically to a drive shaft for imparting rotational movement to the rotor to generate fluid flow from the inlet ports of the chamber to the outlet ports of the chamber, wherein the drive shaft passes through an opening in the cover coaxial with the stator gear, a drive motor operatively connected to the drive shaft for imparting rotational motion thereto, and a ducting system operatively connecting the inlet ports of the chamber to the outlet of the compartment for creating a pressure drop from the inlet to the outlet of the compartment.

In accordance with yet another aspect of the invention, a pump comprises a one-piece housing having a chamber therein with an epitrochoidal planform according to the equation $$x=(a+b)\cdot\cos(t)-c\cdot\cos((a/b+1)\cdot t), \text{ and}$$

$$y=(a+b)\cdot\sin(t)-c\cdot\sin((a/b+1)\cdot t),$$

x and y being plotted from a center of the chamber, wherein $0\leqq t\leqq 2\pi$, a/b is an integer defining the number of lobes of said chamber, and b/c=2, a stator gear in the chamber at the center thereof, the gear having (a/b)·n teeth (n being an integer), a generally polygonal, one-piece rotor with (a/b+1) curved sides, the rotor being disposed for eccentric rotation in the chamber, a rotor gear at a center of the rotor, the rotor gear having (a/b+1)·n teeth, a cover mounted to the housing to enclose the chamber, and seal means on the rotor for sealing the rotor and the housing during rotation of the rotor in the housing, the seal means being constructed for permitting a predetermined pressure drop thereacross.

BRIEF DESCRIPTION OF THE DRAWINGS

The objects of the invention will be better understood from the detailed description of its preferred embodiments which follows below, when taken in conjunction with the accompanying drawings, in which like numerals refer to like features throughout. The following is a brief identification of the drawing figures used in the accompanying detailed description.

FIG. 4 is a cross-sectional view taken along line 4—4 in FIG. 3.

FIG. 8(*a*) is a plan view of a second embodiment of a rotor for a vacuum pump in accordance with the present invention, and FIG. 8(*b*) is a sectional view taken along line 8*b*—8*b* in FIG. 8(*a*).

FIG. 9(*a*) is a plan view of another alternative embodiment of a rotor for a vacuum pump in accordance with the present invention, and FIG. 9(*b*) is a sectional view taken along line 9*b*—9*b* of FIG. 9(*a*).

FIG. 10 is a plan view of still another embodiment of a rotor for a vacuum pump in accordance with the present invention.

FIG. 11 is a detailed view of an alternate embodiment of the invention depicting a blow-by seal attached to the housing of the vacuum pump.

DETAILED DESCRIPTION OF PREFERRED EMBODIMENTS

Figure 1:
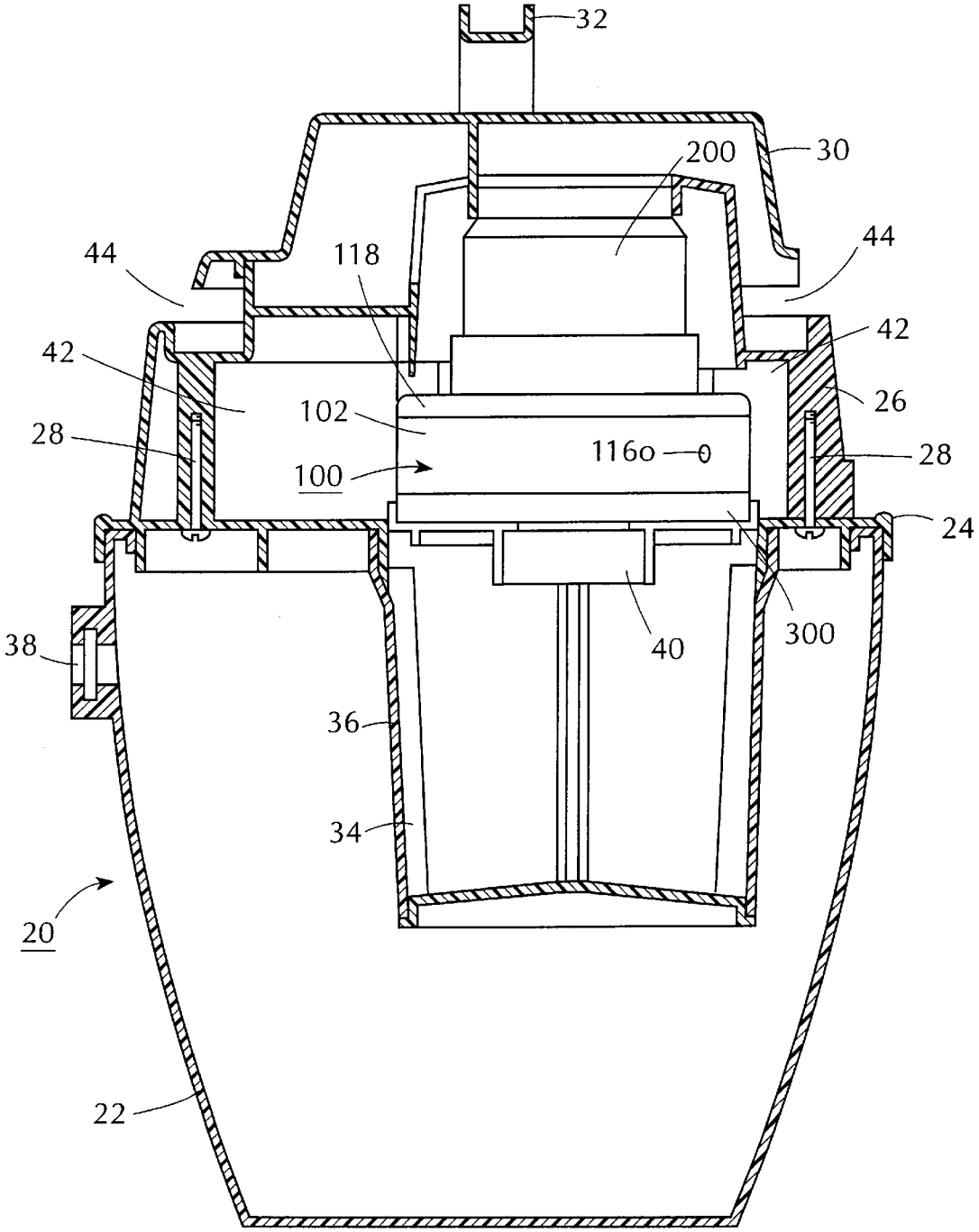
FIG. 1 is a schematic depiction in cross-section of a conventional tank-type vacuum cleaner incorporating a vacuum pump in accordance with the present invention.

Referring to FIG. 1, a conventional tank-type vacuum cleaner 20 is schematically depicted (partially in cross section) as having a generally cylindrical tank or compartment 22 that is free standing on its lower end. An example of this type of vacuum cleaner is shown in detail in U.S. Pat. No. 4,435,877, and the manner of making and assembling it will be clear from that patent to those skilled in the art.

As explained in U.S. Pat. No. 4,435,877, a lid 24 is secured to the tank 22 by buckle clamps (not shown). A motor housing 26 is secured to the lid 24 by screws 28. A cover 30 with a handle 32 is secured to the motor housing 26 in a suitable manner, as described in U.S. Pat. No. 4,435,877. A circular cage 34 depends from the lid 24 and supports a dust filter 36. An air inlet 38 is provided at the periphery of the tank 22.

In a manner well known to those skilled in the art, an impeller mounted in the lid 24 applies a reduced pressure to an aperture 40 in the lid proximate to the axis of the tank 22. The inlet 38 is oriented to introduce the air flow into the tank 22 in a generally circumferential direction. An air flow is thus produced from the inlet 38, through the dust filter 36, through the aperture 40, to a plenum 42 at the outlet of the impeller and eventually to an exhaust 44. As dust- and debris-laden air is drawn in through air inlet 38, it is directed circumferentially of the tank 22 so that a rotational air flow is set up inside the tank 22. The angular momentum of the air flow causes the heavier dust and debris to impinge on the walls of the tank 22 and fall to the bottom. Proximate to the central axis of the tank, where the aperture 40 is located, the air is relatively dust-free. The filter 36 removes most of the dust that remains, and the air is then expelled from the impeller through the plenum 42 to the exhaust opening 40.

Known prior art uses some type of fan as the impeller for such a vacuum cleaner. For example, U.S. Pat. No. 4,435,877 uses a pancake-type fan impeller in a shallow, round fan housing. In accordance with the present invention, a lobed vacuum pump 100 is used in place of the impellers used in the prior art. Such a vacuum pump in accordance with representative embodiments of the invention is described in more detail below.

The present invention also encompasses the use of a vacuum pump according to the present invention in other kinds of vacuum cleaners, such as upright- or canister-type vacuum cleaners.

Figure 2:
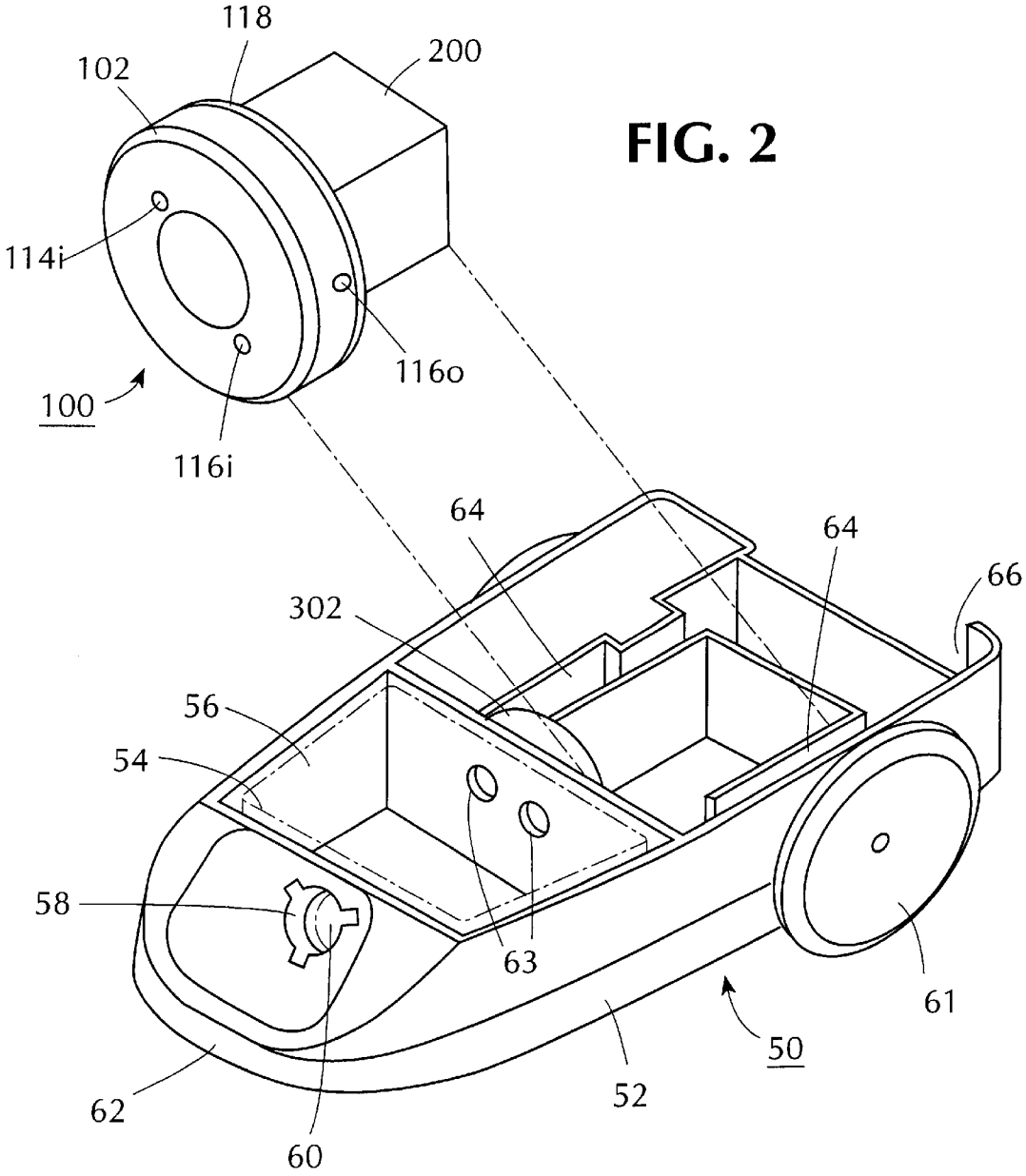
FIG. 2 is a schematic perspective view of part of a conventional canister-type vacuum cleaner incorporating a vacuum pump in accordance with the present invention.

FIG. 2 schematically depicts part of the housing of a conventional canister-type vacuum cleaner 50 incorporating a lobed vacuum pump device in accordance with the present invention. An example of a more or less typical canister-type vacuum cleaner is shown in U.S. Pat. No. 4,970,753, and the manner of making and assembling it will be clear from that patent to those skilled in the art.

As explained in U.S. Pat. No. 4,970,753, a casing lower portion 52 together with an upper portion (not shown) form an enclosure for the components of the vacuum cleaner. A dust collecting compartment 54 receives a disposable filter bag 56 (shown in phantom lines) that provides a dust collecting container. An inlet 58 to the compartment 56 introduces dust-laden air into an inlet 60 of the bag 56. In a manner well-known to those skilled in the art, the bag 56 is made of a cloth material that passes air but captures particulate matter entrained in the air. The vacuum cleaner 50 includes other conventional parts such as wheels 61 to aid in transporting it and a carrying handle 62.

An outlet of the compartment may comprise one or more outlet ports 63 in fluid communication with an impeller, which in the prior art is some type of fan, as in the vacuum cleaner described in connection with FIG. 1. The fan creates a reduced pressure at the outlet ports 63, thus creating an air flow from the inlet 58, through the bag 56, to the outlet ports 63. The exhaust from the fan is directed through a series of plenums 64, and other suitable noise-reducing devices if desired, to an exhaust opening 66.

In accordance with the present invention, a Wankel-type vacuum pump 100 is used in place of the fan-type impeller of prior art vacuum cleaner.

One embodiment of such a pump in accordance with the present invention is depicted in FIGS. 3 to 7.

Figure 3:
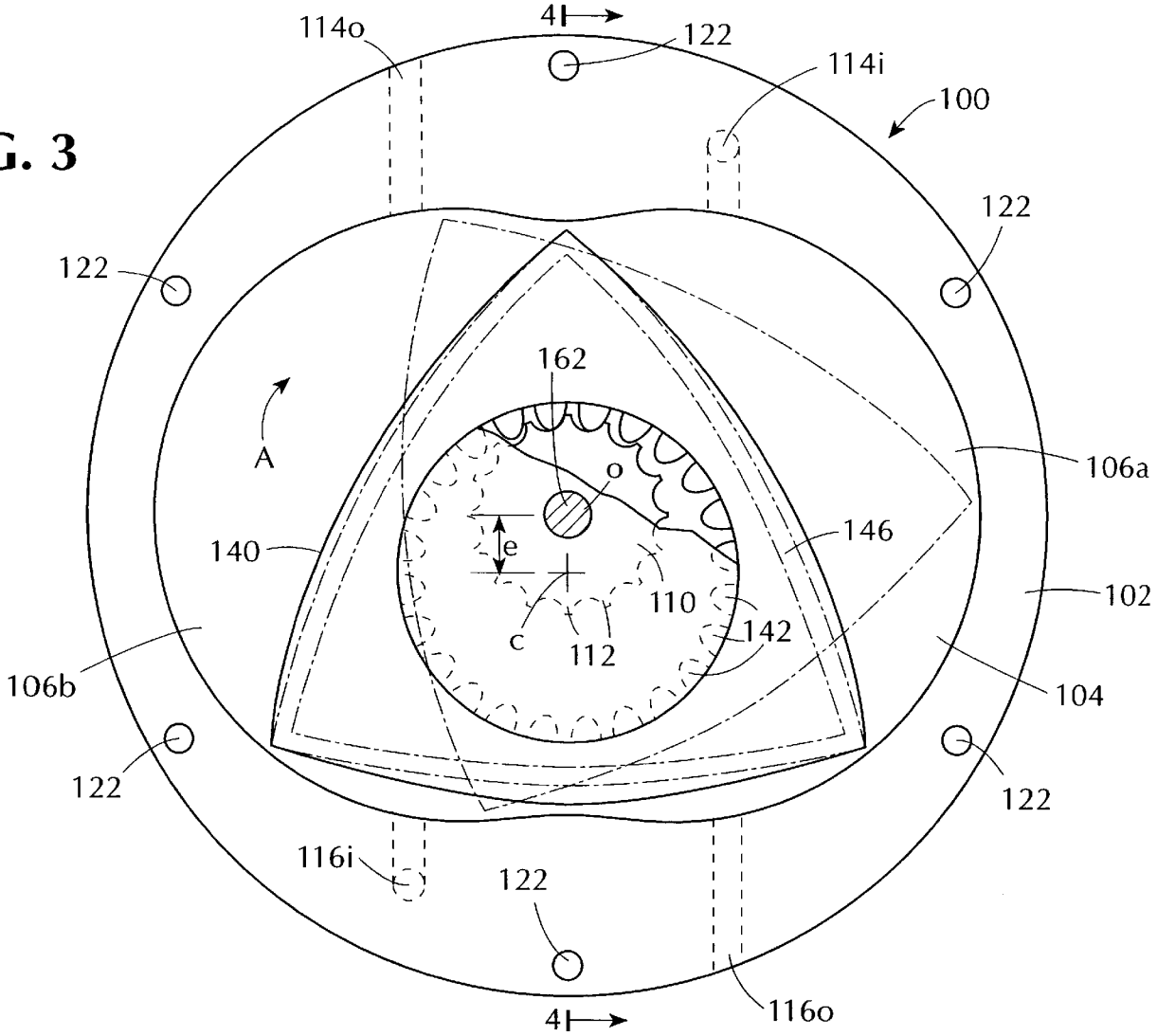
FIG. 3 is a plan view of a vacuum pump device in accordance with the present invention.

FIG. 3 is a plan view of a vacuum pump 100 in accordance with the present invention. The device includes a housing 102 that is constructed to form a chamber 104 having a plurality of lobes 106*a* and 106*b*. In a particularly advantageous embodiment of the invention, the housing 102 can be injection molded of a suitable plastic material, thus making it possible to mass-produce the housing and lower the cost of the device. The reason the housing can be made of a low-strength material is that it need not withstand high pressures and does not have to be constructed to close tolerances to be used in a vacuum cleaner.

The chamber 104 can most advantageously have an epitrochoidal planform in accordance with the following equations that define a "classic" Wankel-type enclosure:

$$x=(a+b)\cdot\cos(t)-c\cdot\cos((a/b+1)\cdot t) \quad (2)$$

$$y=(a+b)\cdot\sin(t)-c\cdot\sin((a/b+1)\cdot t) \quad (3)$$

When $0 \leqq t \leqq 2\pi$, b/c=2, and a/b is an integer, these equations define a locus of points about an origin O (see FIG. 6) located at the center of the chamber. That is, the center of the chamber is defined as the origin for the locus of points defined by equations (2) and (3). The value of a/b determines the number of lobes in the so-defined chamber. In a preferred embodiment a/b=2, but the chamber can have any number of lobes in accordance with the invention.

The chamber 104 extends into a face of the housing 102 to a depth d (see FIG. 4). Integrally molded into the bottom 108 of the housing 102 is a circular stator gear 110 centered at the origin O of the curve defined by equations (2) and (3). (See FIG. 6.) The stator gear 110 has (a/b)·n teeth 112 (n being an integer). In the present embodiment a/b=2 and n=8, so that there are 16 teeth 112 on the stator gear 110. As with the number of lobes in the chamber, the number of teeth on the stator gear may be varied within the practice of the present invention by varying the value of n.

The housing 102 also has molded into it two inlet ducts 114*i* and 116*i* and two outlet ducts 114*o* and 116*o*. The inlet and outlet ducts 114 and 116 provide flow paths from predetermined locations in each lobe 106 of the chamber 104 for a purpose that will be clearer as the present description proceeds.

The chamber 104 further includes a cover 118 secured to the face of the housing 102 into which the chamber 104 is formed. The cover 118 is attached to the housing 102 by a suitable number of screws 120 that thread into blind holes 122 machined into the housing 102 after it is molded. A gasket 124 of a suitable material such as rubber is captured between the cover 118 and housing 102 and is compressed upon assembly of the cover to the housing to make the chamber air-tight. (The cover 118, screws 120 and gasket 124 are omitted from FIG. 3 for clarity.) It will be appreciated that any suitable sealing material or arrangement, such as one or more O-rings, may be used instead of or in addition to the gasket 124 to seal the cover 118 and the housing 102. In addition, other embodiments can be made without any such seal, because of the relatively low pressures at which the vacuum pump operates and the tolerance for small amounts of leakage when the vacuum pump is used in a vacuum cleaner.

Figure 5:
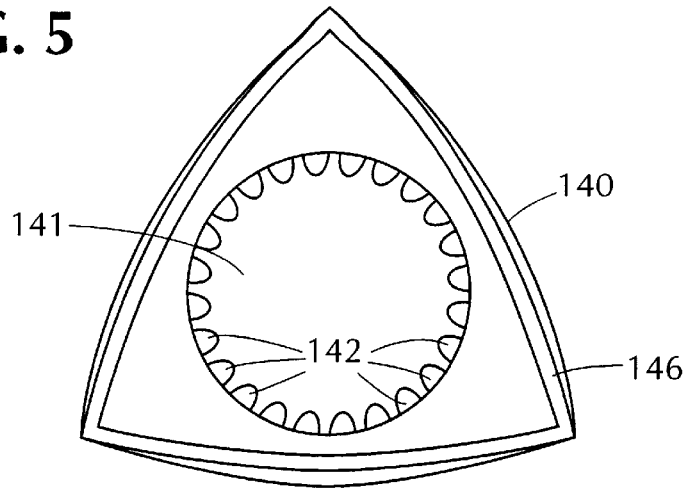
FIG. 5 is a plan view of a first embodiment of a rotor for a vacuum pump in accordance with the present invention.
Figure 6:
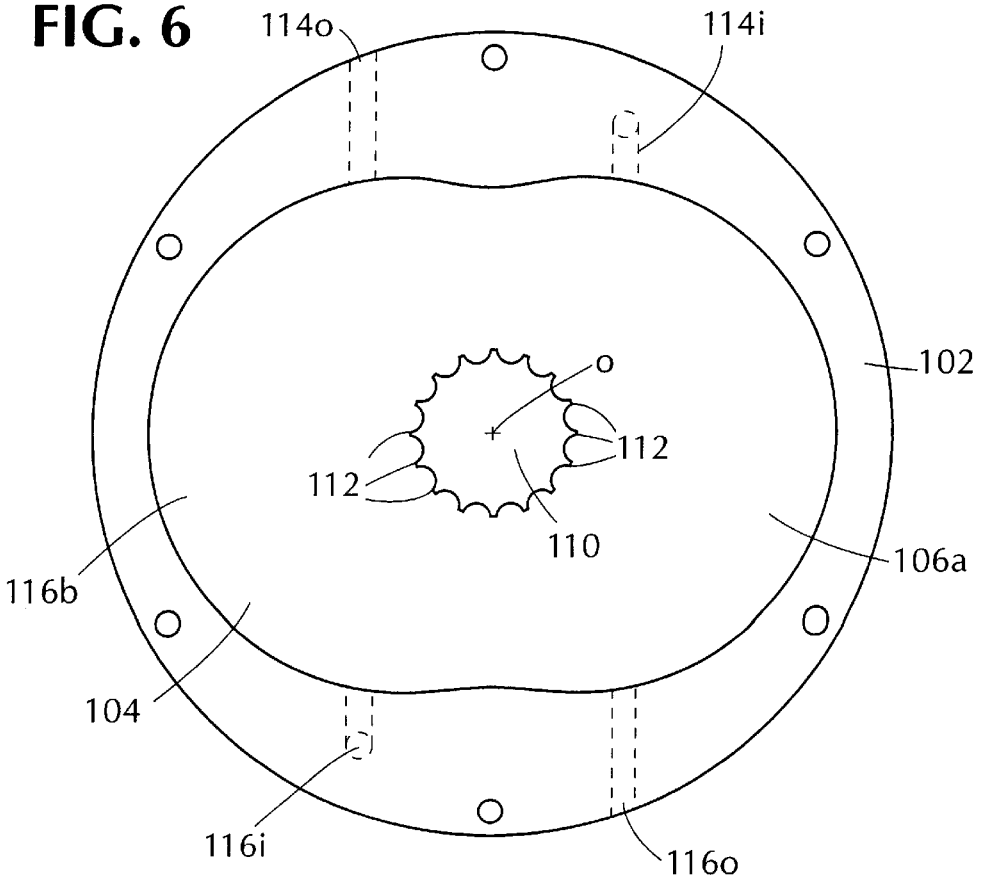
FIG. 6 is a plan view of a housing for a vacuum pump in accordance with the present invention.

The vacuum pump of the present invention also comprises a rotor 140, shown in detail in FIG. 5. The rotor 140 is a regular polygon with a/b+1 curved sides. In the present embodiment, the rotor 140 is generally triangular (a/b+1=3). The configuration of the rotor 140 is designed to provide a desired compression ratio, say 5:1, although other compression rates are possible within the scope of the invention. That is, consistent with other performance requirements (see below), the curvature of the rotor's sides is chosen so that the maximum volume of the space between the rotor and the housing is a predetermined multiple of the minimum volume; in a preferred embodiment that multiple is about five. The rotor 140 is also most advantageously injection molded in one piece from a suitable plastic material, or may be cast of a metal such as aluminum. One important consideration may be that the materials used to make the housing and the rotor will prevent or inhibit binding as the rotor travels within the housing, depending on the sealing arrangement used (as discussed below).

The rotor 140 has a central circular opening 141 through it. A portion of the axial extent of the opening 141 includes a rotor gear. The opening 141 has a center C at the geometric center of the regular polygon comprising the rotor. If the rotor is injection molded, the opening is molded with the rotor gear in place to provide a one-piece rotor. As best seen in FIG. 3, the rotor gear teeth 142 mesh with the stator gear 110 to control the rotation of the rotor 140 within the chamber 104. The rotor gear has (a/b+1)·n teeth. Since n=8 in the present embodiment, the rotor gear has 24 teeth. The rotor gear teeth 142 are curved to form convexly curved gear teeth, which mesh closely with the generally matching concavely curved teeth 112 on the stator gear 110. This arrangement provides for more positive angular placement of the rotor 140 as it travels through the chamber 104.

The rotor 140 is also molded with a groove 146 in each face (see also FIG. 4). Each groove 146 is continuous and for its entire length is spaced the same distance from the edge of the rotor. Each groove carries a flexible seal 148 made of a suitable material such as felt, rubber, aluminum, plastic or any other material that will slide easily over and not bind with the material used to make the housing 102 and the cover 118, since the seal 148 bears against the bottom 108 of the housing 102 and the inside of the cover. 118 (see FIG. 4). The groove 146 in each face approaches the edge of the rotor in the vicinity of each apex of the polygonal rotor. By controlling how close the groove is to the edge at the apexes, and the amount of clearance maintained between the apexes and the chamber walls as the rotor rotates (see FIG. 3), the pressure drop across the seals can be controlled in accordance with a feature of the invention discussed in more detail below.

Figure 7:
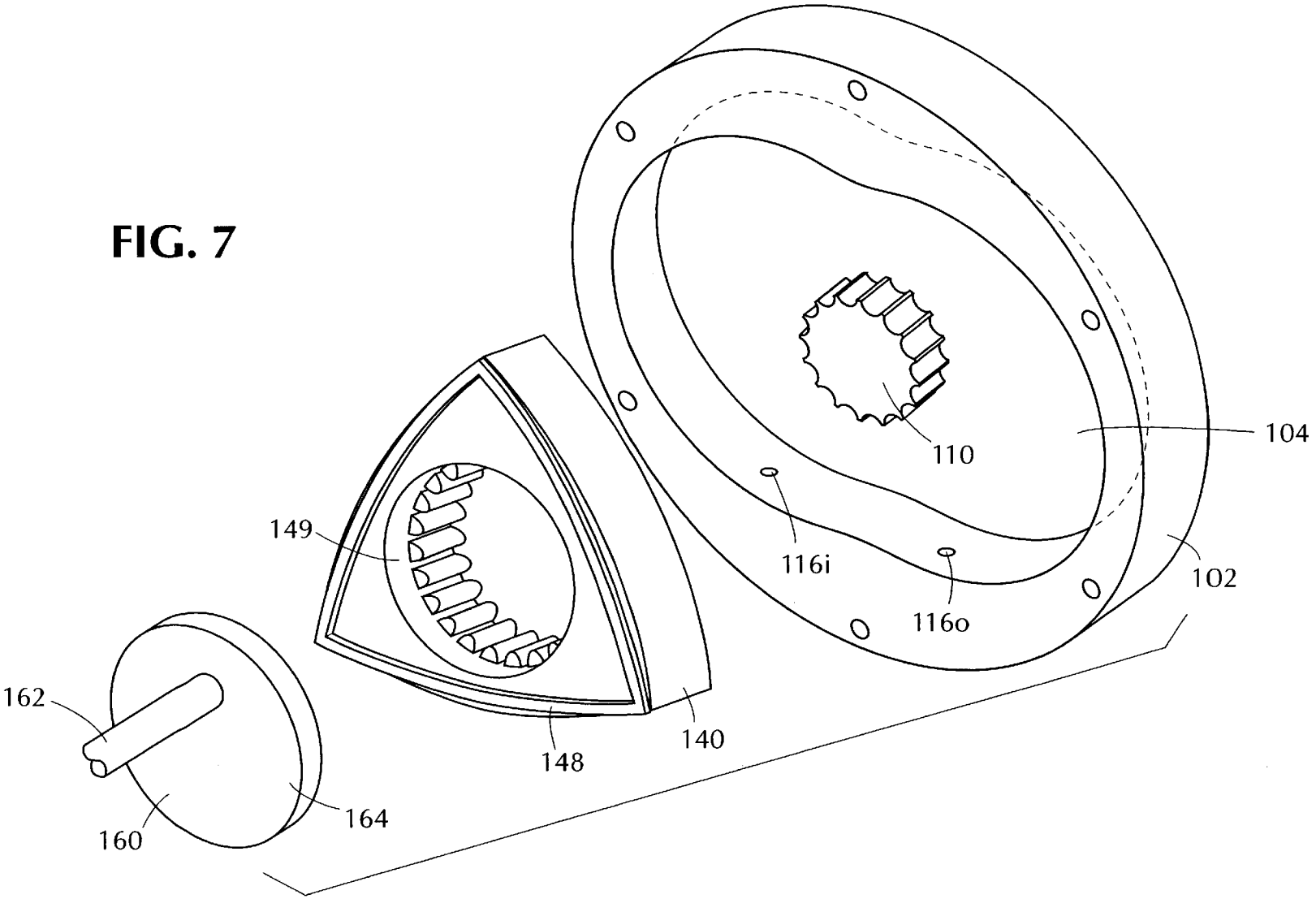
FIG. 7 is an exploded perspective view of a vacuum pump in accordance with the present invention.

The manner of driving the rotor will be best appreciated from FIGS. 3, 4, and 7 taken together. The rotor 140 is driven in an eccentric rotary motion within the housing 102 by a drive member 160. The drive member comprises a drive shaft 162 connected to the shaft of an electric motor 200 (see FIGS. 1 and 2). The drive shaft carries an eccentrically mounted, round disc 164 rigidly secured to the drive shaft with the center of the circular disc 164 offset from the axis of the drive shaft by a distance e (see FIG. 3). That is, those skilled in the art will appreciate that for the compressor device 100 to operate properly, the center C of the rotor gear must subscribe a circle with a radius e around the center O of the stator gear. To provide such rotation, the drive shaft 162 is mounted coaxially with the center O of the stator gear in a journal bearing 166 in the cover 118. The drive disc 164 is disposed within the axial extent 149 of the rotor central opening 141 not occupied by the rotor gear. Thus, when the drive disc rotates, the rotor 140 travels within the chamber 104 with the proper eccentric motion. The drive disc is made of a material that easily permits relative motion between itself and the rotor as the drive disc propels the rotor within the chamber.

The vacuum pump 100 is provided in a vacuum cleaner such as the tank-type vacuum cleaner 20 shown in FIG. 1 or the canister-type vacuum cleaner shown in FIG. 2, by using a ducting system that attaches the intake ports 114*i* and 116*i* to the outlet of the dust-collecting chamber.

Specifically, the tank-type vacuum cleaner 20 shown in FIG. 1 includes a manifold 300 that fits between the housing 102 and the aperture 40. The manifold 300 has on one end a central opening (not shown) that opens into the aperture 40. Ports (not shown) connect the interior of the manifold 300 with the intake ports 114*i* and 116*i* of the chamber 104. As seen in FIG. 4, the housing 102 is molded with the intake ports exiting the housing 102 in one of its faces, so that the intake ports are in direct communication with the interior of the manifold. The outlet ports 114*o* and 116*o* can also be molded to exit from the housing 102 at any convenient location, but in this embodiment they exit from the edge face of the housing 102, as shown in FIGS. 3 and 4, into plenum 42.

The canister-type vacuum cleaner 50 shown in FIG. 2 also includes a manifold 302 that communicates with the compartment 54 through the ports 63. The intake ports 114*i* and 116*i* of the compressor device of the present invention communicate directly with the manifold 302 when the vacuum pump 100 is assembled into the vacuum cleaner 50. The outlet ports 114*o* and 116*o* of the device 100 lead directly into the exhaust plenum 64.

In operation the drive shaft 162 is operatively connected to the motor 200 in a suitable manner (discussed in more detail below) and rotates the rotor 140 in the direction of arrow A in FIG. 3. As the rotor 140 rotates it creates with the chamber 104 four volumes, two in each lobe 106*a* and 106*b*. Each volume first expands to draw air in through one of the inlet ports 114*i* and 116*i*, and then a corner of the rotor passes each inlet port and each volume is then reduced (by a ratio of about 5:1, as discussed above), which forces the air in that volume out of one of the outlet ports 116*o* and 114*o*, respectively. In this manner, the pump creates a pressure drop between its inlet and outlet ports to draw dust- and dirt-laden air through the vacuum cleaner in which it is installed.

A primary advantage of the present invention is that it enables pressure drops ("vacuums") comparable to those in conventional vacuum cleaners with rotational speeds a fraction of those required in such conventional units. For example, the speed $\omega$ of the rotating parts in conventional vacuum cleaners can be as high as 28,000 to 32,000 rpm (see U.S. Pat. No. 5,159,738). A vacuum cleaner with the compressor device of the present invention can run at an angular velocity $\omega$ of a magnitude of about 5000 rpm. Since dipole noise is proportional to $\omega^6$, it will be appreciated that the noise reduction possible with the present invention is significant. Viewed another way, the industry standard measurement of vacuum cleaner performance is termed "air watts," which is the mass flow rate through the vacuum cleaner multiplied by the pressure drop $\Delta p$ across the unit's impeller. Since the compressor device of the present invention is able to generate a much higher $\Delta p$ for a given angular velocity $\omega$, it can provide a vacuum cleaner with the same power rating in air watts at a much lower rotational speed.

The shaft of the motor 200 is attached to the shaft 162 of the drive member 160 by a flexible coupling, preferably a hollow rubber tube (not shown). The motor is mounted in the vacuum cleaner with shock absorbing mountings to isolate the housing from the motor's vibrations. This vibration isolation is enhanced by the flexible coupling between the compressor device and the motor. Accordingly, the vacuum cleaner can be made even quieter.

In a typical device in accordance with the present invention, the housing is molded in one piece and is 30 mm thick and circular in planform with a diameter of 200 mm. The depth d of the chamber is 25 mm. The stator gear has an outside diameter (measured across the tops of the gear teeth) of 42.15 mm, and each gear tooth is circularly concave with a diameter 7.00 mm. The rotor is molded in one piece and measures 125 mm from apex to apex and the curved sides have a radius of 160 mm. The rotor is 24 mm thick, and the circular opening having the rotor gear is 70 mm in diameter. The rotor gear teeth are rounded at their ends to a radius of 1.5 mm. With such a device rotating in the direction of the arrow A in FIG. 3 at a speed of about 5000 rpm, a pressure drop of about 0.1 atmospheres is generated. This is in excess of the pressure drop usually provided by conventional vacuum cleaners, thus reducing the mass flow rate (and air flow velocity) necessary to provide the same amount of power in air watts. It will be appreciated by those skilled in the art that other dimensions and configurations of the compressor device may be used to provide any desired mass flow rate and pressure drop.

The configuration of the rotor is chosen to provide a predetermined clearance between the rotor's curved sides and the narrowed portion of the chamber 104 separating the lobes 106*a* and 106*b*. It is important in the present invention that such clearance be as small as possible so that fluid communication between the chambers defined by the lobes is minimized as the rotor rotates. The size of this clearance is determined by properly choosing the radius of curvature of the rotor's sides relative to the chamber's dimensions.

If this clearance is too large, it will adversely affect the performance of the pump because there will be excessive fluid flow between the chambers, and thus undesired communication between the inlet 116*i* and the outlet 116*o* and the inlet 114*i* and the outlet 114*o*.

If desired, blow-by seals 300 may be added to the housing to further inhibit this fluid communication. Such a seal in accordance with an alternate embodiment of the invention is shown in FIG. 11, which is an enlarged view of the bottom portion of the housing 102 (as seen in FIG. 3) where the lobes 106*a* and 106*b* are joined. The blow-by seal in this embodiment is a small spring steel clip 302. One end 304 of the clip fits in a slot 102*x* in the housing and the other end 306 of the clip fits in a slot 102*y* in the housing. The central portion 308 of the clip is slightly bowed outwardly into the chamber so that the rotor will slide over the clip as it rotates within the housing. Another blow-by seal would be provided at the upper portion of the housing where the lobes 106*a* and 106*b* are joined.

The device of the present invention is a positive displacement compressor, so that an obstruction in the intake of the device will result in a significantly increased pressure drop, unlike conventional vacuum cleaners. If not accounted for, that could be potentially dangerous because the obstruction at the intake could be an object at the end of the hose used to pick up the dirt and debris being cleaned by the vacuum cleaner. If that obstruction were a fragile article, such as draperies or a lamp, or a pet or small child, breakage or serious injury could result. Therefore, it is an important feature of this embodiment of the present invention that the inlet port 114*i* and the outlet port 116*o* of the lobe 106*a*, and the inlet port 116*i* and the outlet port 114*o* of the lobe 106*b*, are located so that for at least part of the travel of the rotor the inlet port and outlet port for each lobe are in direct communication. This is shown by the phantom line location of the rotor 140 depicted in FIG. 3. That way, the pressure drop that can be generated is limited because the inlet and outlet will always be in direct fluid communication during at least part of the rotor's travel.

Those skilled in the art will appreciate that the vacuum pump of the present invention can use sealing arrangements other than the flexible seal 148 of felt or the like in the above embodiment.

FIGS. 8(*a*) and 8(*b*) depict an alternate embodiment of a rotor incorporating an integral seal suitable for use in the present invention. The rotor 140' depicted in FIG. 8 has raised seals 248 integrally molded into its faces, rather than having a strip seal like the seal 148 carried in grooves 146 as shown in the previous embodiment. The raised seals 248 are generally rounded on top and provide a slight clearance between the rotor and the housing (and cover) so that small particulate matter entrained in the fluid can pass through the seals without abrading them. The rotor 140' is especially useful when the pump of the present invention is used to move liquids other than air. An advantage of this embodiment is that the seat 248 can be placed closer to the edge of the rotor at the rotor apexes, and the seal cross-section can even be profiled to more precisely control the pressure drop thereacross. FIG. 8(*b*) shows a seal with a generally semi-circular cross-section, but other cross-sections representing more or less of a circle, or even assuming a non-circular configuration, or a configuration that changes along the length of the seal, can be adopted.

FIGS. 9(*a*) and 9(*b*) depict another alternate embodiment of a sealing arrangement in accordance with the present invention. The rotor 140" in accordance with the present embodiment has a keyhole-shaped cutout 150 at each apex (only one of which is shown in FIG. 9). The cutout 150 has disposed in it an apex sealing member 250. The apex sealing member includes an enlarged body portion 252 that fits relatively snugly within the inner portion cutout 150 and an integral tongue 254 that extends through the leg of the keyhole cutout 150 and beyond the apex of the rotor 140".

The rotor 140" includes grooves 146" that correspond to the grooves 146 in the first embodiment discussed above. However, in the present embodiment the grooves can be made equidistant from the rotor edges throughout the length of the groove. The faces of the sealing member 250 also include grooves 256 that are in alignment with the grooves 146". Seals 148 (shown in phantom lines in FIG. 9(*b*)) fit into the grooves 146" as in the previous embodiment, and also into the grooves 256 in the sealing member 250. The apex sealing member 250 extends beyond the faces of the rotor 140", as seen in FIG. 9(*b*), to be flush with the sealing surface of the peripheral seals 148.

The seals 148 themselves interlock with the sealing member 250, and since the seals are flexible they permit the apex sealing member 250 to move in the directions of arrow B as the rotor travels within the housing. It will be appreciated that the apex sealing member 250 will be "biased" to its outermost position by the flexible seals 148 so that it will more positively contact the walls of the chamber 104 throughout the rotor travel in the housing (see FIG. 3). The end of the tongue 254 of the apex sealing member will typically be slightly curved to conform more closely with the internal surfaces of the lobes 106*a* and 106*b*, thereby providing a more effective seal as the rotor travels within the housing 102. In addition, the sealing member 250 can be made of a material that is softer than the material used for the housing so that the tip of the tongue 254 wears into the shape that most closely conforms with the internal contour of the chamber 104.

In any event, the present embodiment has the advantage of providing a more positive seal, which may be particularly advantageous when the device of the present invention is used for applications other than a consumer vacuum cleaner. That is, although this sealing arrangement is more complex, it also provides a better seal and can be replaced when worn by particulate matter entrained in the fluid being moved by the device. It also has the advantage of permitting use of the optimum material for the seal members 148 and 250 and thus allowing greater leeway in the materials used for the housing 102 and the rotor 140.

FIG. 10 depicts a variation of the embodiment shown in FIG. 9. In FIG. 10, the keyhole cutout 150 is replaced by a slot 150' with straight sides, and the apex sealing member 250' is configured to fit within the slot 150'. The sealing member 250' may be biased outwardly by a small compression spring (not shown) in the root of the slot. (It will be appreciated that a spring can be used to the same purpose in the FIG. 9 embodiment.)

The embodiment in FIG. 10 has the advantage of being easier to manufacture than the embodiment of FIG. 9, although the apex sealing member is not retained as well.

From the above description it will be clear that the present invention is suitable for use in environments other than a vacuum cleaner. It is particularly useful for pumping with entrained particulate matter because it is a feature of the invention that it does not include the elaborate sealing arrangements found in prior art Wankel-type devices that must withstand extremely high pressure drops across the seals.

In contrast, the present invention uses seal means specifically made to allow flow across the seals at a predetermined pressure drop. Examples of seal structure performing the function of allowing a predetermined pressure drop are discussed above, but any sealing structure that performs such a function is within the scope of the present invention. Examples other than those specifically discussed and illustrated above would include using C-shaped spring clips at the apexes of the rotor, with the legs of the spring clips disposed in slots in the edge faces of the rotor and the middle portion of the spring clips in contact with the walls of the chamber 104. Another example of such a seal would involve having a reduced thickness portion at each rotor apex to provide a flexible portion integral with the rotor. Such arrangements could be used with face seals like those already discussed or with alternate face seal structure.

In summary, the present invention in its broad aspects involves a Wankel-type pumping device that is especially suited for use with fluids in which particulate matter is entrained. The Wankel-type device of the present invention uses seals that, unlike those used in prior art Wankel-type devices, are specifically constructed to allow a predetermined pressure drop (and thus a predetermined amount of fluid flow) across the seal. By incorporating such seals in the device, the seals need not be made to close tolerances using expensive materials and with exotic configurations; instead the seals can be made inexpensively of robust materials to provide long seal life even in highly abrasive environments.

One such environment to which the present invention in particularly suited is a vacuum cleaner. Even though the Wankel-type pumping device of the invention is used in a gritty, dirty environment, it can be made sufficiently inexpensively and will require no more maintenance than a conventional vacuum cleaner.

While preferred embodiments of the invention have been depicted and described, it will be understood that various modifications and changes can be made other than those specifically mentioned above without departing from the spirit and scope of the invention, which is defined solely by the claims that follow.

What is claimed is:

1. A pump for moving fluid, said pump comprising:

a housing having faces and a circumferential wall forming a chamber with a plurality of lobes;

a stator gear in said chamber at a center thereof;

a generally polygonal rotor with a plurality of sides greater in number than said plurality of lobes, said rotor being disposed in said lobed chamber with faces of said rotor opposed to said housing faces for unconstrained movement of said rotor faces relative to said housing faces;

a rotor gear at a center of said rotor meshed with said stator gear; and a drive member for operating said pump to move fluid from an inlet of said chamber to an outlet of said chamber by imparting eccentric rotational motion to said rotor within said chamber to generate a reduced pressure in said lobes as said rotor rotates relative to said chamber, wherein apexes of said rotor are spaced from said housing wall and have no sealing members for contacting said wall, thereby maintaining a clearance between said apexes and said wall as said rotor rotates in said chamber so that fluid flows through said clearance when said drive member operates said pump.

2. A pump as in claim 1, wherein said rotor is molded in one piece.

3. A pump as in claim 2, wherein said housing is molded in one piece.

4. A pump as in claim 1, further comprising a seal extending around said rotor on at least one face thereof.

5. A pump as in claim 4, wherein said rotor is molded in one piece and each said face seal includes a ridge molded in said face of said rotor.

6. A pump as in claim 1, wherein:

said chamber has narrowed portions separating said lobes; and said rotor is configured so that a clearance for permitting fluid flow therethrough is maintained between said sides thereof and said narrowed portions of said chamber as said rotor rotates in said chamber.

7. A pump as in claim 6, wherein said chamber has two of said lobes separated by opposing narrowed portions and said rotor has two of said sides.

8. A pump as in claim 1, wherein:

said drive member includes a disc fitting within a circular opening in one of said faces of said rotor and mounted eccentrically to a drive shaft, said disc being in sliding contact with said circular opening; and said drive shaft passes through a hole in one of said faces of said housing, said hole being coaxial with said stator gear and said drive shaft being in sliding contact with said hole.

9. A vacuum pump capable of generating a reduced-pressure fluid flow in which particulate matter is entrained, said vacuum pump comprising:

a pump housing having faces and a circumferential wall forming a chamber with a plurality of lobes, each of said lobes of said chamber having at least one outlet port and at least one inlet port disposed therein;

a stator gear in said chamber at a center thereof;

a rotor with a plurality of sides greater in number than said plurality of lobes, said rotor being disposed in said lobed chamber with faces of said rotor opposed to said housing faces for unconstrained movement of said rotor faces relative to said housing faces;

a rotor gear at a center of said rotor meshed with said stator gear; and a drive member for operating said pump to move fluid from said inlet ports to said outlet ports by imparting eccentric rotational motion to said rotor within said chamber to generate a reduced pressure in said lobes as said rotor rotates relative to said chamber for producing fluid flow from said inlet port of said chamber to said outlet port of said chamber, wherein apexes of said rotor are spaced from said housing wall and said apexes have no sealing members for contacting said wall, thereby maintaining a clearance between said apexes and said wall as said rotor rotates in said chamber so that fluid flows through said clearance when said drive member operates said pump.

10. A vacuum pump as in claim 9, wherein:

said chamber includes at least two outlet ports, each of said lobes of said chamber having at least one said outlet port disposed therein;

said chamber includes at least two inlet ports, each of said lobes of said chamber having at least one said inlet port disposed therein; and at least one said inlet port and one said outlet port in different said lobes of said chamber are in direct fluid communication during a portion of said rotation of said rotor.

11. A vacuum pump as in claim 9, wherein said rotor is molded in one piece.

12. A vacuum pump as in claim 11, wherein said housing is molded in one piece.

13. A vacuum pump as in claim 9, wherein:

said drive member includes a disc fitting within a circular opening in one of said faces of said rotor and mounted eccentrically to a drive shaft, said disc being in sliding contact with said circular opening; and said drive shaft passes through a hole in a cover attached to said housing forming one of said faces thereof, said hole being coaxial with said stator gear and said drive shaft being in sliding contact with said hole.

14. A vacuum pump as in claim 9, further comprising a seal extending around said rotor on at least one face thereof.

15. A vacuum pump as in claim 14, wherein said rotor is molded in one piece and each said face seal includes a ridge molded in said face of said rotor.

16. A vacuum pump as in claim 9, wherein:

said chamber has narrowed portions separating said lobes; and said rotor is configured so that a clearance for permitting fluid flow therethrough is maintained between said sides thereof and said narrowed portions of said chamber as said rotor rotates in said chamber.

17. A vacuum pump as in claim 16, wherein said chamber has two of said lobes separated by opposing narrowed portions and said rotor has three of said sides.

18. A pump for moving fluid having particulate matter entrained therein, said pump comprising:

a one-piece molded housing body and a cover attached thereto to form a housing having faces and a circumferential wall forming a chamber with an epitrochoidal planform satisfying the equation $$x=(a+b)\cdot\cos(t)-c\cdot\cos((a/b+1)\cdot t), \text{ and}$$

$$y=(a+b)\cdot\sin(t)-c\cdot\sin((a/b+1)\cdot t),$$

x and y being plotted from a center of said chamber, wherein $0\leqq t\leqq 2\pi$, a/b is an integer defining the number of lobes of said chamber, and b/c=2;

a stator gear in said chamber at said center thereof, said stator gear having (a/b)·n teeth, wherein n is an integer;

a one-piece molded rotor with a generally polygonal planform having (a/b+1) curved sides and generally flat opposing faces, wherein said rotor is disposed in said lobed chamber with said rotor faces opposed to said housing faces for unconstrained movement of said rotor faces relative to said housing faces;

a rotor gear at a center of said rotor, said rotor gear being meshed with said stator gear and having (a/b+1)en teeth, wherein one of said rotor faces has therein a circular opening coaxial with said rotor gear;

a drive member including a circular drive disc mounted eccentrically to a drive shaft passing through a hole in said cover coaxial with said stator gear, said drive disc being fitted in said circular opening for operating said pump to move fluid from said inlet ports to said outlet ports by imparting eccentric rotational motion to said rotor within said chamber to generate a reduced pressure in said lobes as said rotor rotates relative to said chamber, wherein apexes of said rotor are spaced from said housing wall and have no sealing members for contacting said wall, thereby maintaining a clearance between said apexes and said wall as said rotor rotates in said chamber so that fluid flows through said clearance when said drive member operates said pump; and face seals molded in said rotor and extending therearound in each said face of said rotor.

19. A pump as in claim 18, wherein:

a/b=2 for providing two of said lobes separated by opposing narrowed portions; and said rotor is configured so that a clearance for permitting fluid flow therethrough is maintained between said sides thereof and said narrowed portions of said chamber as said rotor rotates in said chamber.

20. A pump as in claim 18, wherein said drive disc is in sliding contact with said circular opening and said drive shaft is in sliding contact with said hole.

21. A method for moving fluid, said method comprising the steps of:

providing a pump including:

a housing having faces and a circumferential wall forming a chamber with a plurality of lobes, a stator gear in said chamber at a center thereof, a generally polygonal rotor with a plurality of sides greater in number than said plurality of lobes, said rotor being disposed in said lobed chamber with faces of said rotor opposed to said housing faces for unconstrained movement of said rotor faces relative to said housing faces, a rotor gear at a center of said rotor meshed with said stator gear, and a drive member for operating said pump to move fluid from an inlet of said chamber to an outlet from said chamber by imparting eccentric rotational motion to said rotor within said chamber to generate a reduced pressure in said lobes as said rotor rotates relative to said chamber, wherein apexes of said rotor are spaced from said housing wall and have no sealing members for contacting said wall, thereby maintaining a clearance between said apexes and said wall as said rotor rotates in said chamber; and operating said pump to move fluid from an inlet of said chamber to an outlet of said chamber by rotating said drive member so that fluid flows through said clearance.

22. A method as in claim 21, wherein:

said drive member includes a disc fitting within a circular opening in one of said faces of said rotor and mounted eccentrically to a drive shaft, said disc being in sliding contact with said circular opening; and said drive shaft passes through a hole in one of said faces of said housing, said hole being coaxial with said stator gear and said drive shaft being in sliding contact with said hole.

23. A method as in claim 21, wherein:

said chamber has narrowed portions separating said lobes; and said rotor is configured so that a clearance for permitting fluid flow therethrough is maintained between said sides thereof and said narrowed portions of said chamber as said rotor rotates in said chamber.

* * * * *